United States Patent [19]

Krugmann

[11] 4,122,197

[45] Oct. 24, 1978

[54] METHOD AND APPARATUS FOR PACKAGING FOOD

[76] Inventor: Alfred Robert Krugmann, Borsigstrasse 9, Reinbek, Germany, 2057

[21] Appl. No.: 815,625

[22] Filed: Jul. 14, 1977

[51] Int. Cl.[2] ..... B65B 55/00

[52] U.S. Cl. ..... 426/232; 53/75; 426/396; 53/432; 53/510

[58] Field of Search ..... 426/396, 392, 402, 410, 426/412, 413, 414, 232; 53/289, 290, 297, 329, 22 R, 112 R, 75; 141/114

[56] References Cited

U.S. PATENT DOCUMENTS

| | | | |
|---|---|---|---|
| 2,177,919 | 10/1939 | Vogt | 141/114 |
| 2,339,896 | 1/1944 | Waters | 53/373 |
| 2,736,656 | 2/1956 | Marshall | 426/396 |
| 3,261,140 | 7/1966 | Lung et al. | 53/22 B |
| 3,501,318 | 3/1970 | Wilson | 426/412 |
| 3,577,698 | 5/1971 | Ruekberg | 426/392 |
| 3,590,557 | 7/1971 | Vogel | 53/289 |
| 3,706,183 | 12/1972 | Talarico | 53/329 |
| 3,759,722 | 9/1973 | Simon | 426/413 X |
| 3,853,999 | 12/1974 | Kentor | 426/413 X |

FOREIGN PATENT DOCUMENTS

| | | | |
|---|---|---|---|
| 713,324 | 7/1965 | Canada | 426/412 |

*Primary Examiner*—Steven L. Weinstein
*Attorney, Agent, or Firm*—Nolte & Nolte

[57] ABSTRACT

A method for packaging foodstuffs including a liquid constituent comprises filling a tray with the foodstuff while the tray is horizontal, applying a cover to the tray and sealing the cover to leave a small gap at the periphery of the tray. The tray is then tipped to bring the gap to the top of the resultant package and the package squeezed so that the liquid moves towards the gap to displace air from the package. Sealing is then completed. Apparatus to effect the method is also disclosed.

20 Claims, 2 Drawing Figures

METHOD AND APPARATUS FOR PACKAGING FOOD

Figure 1:
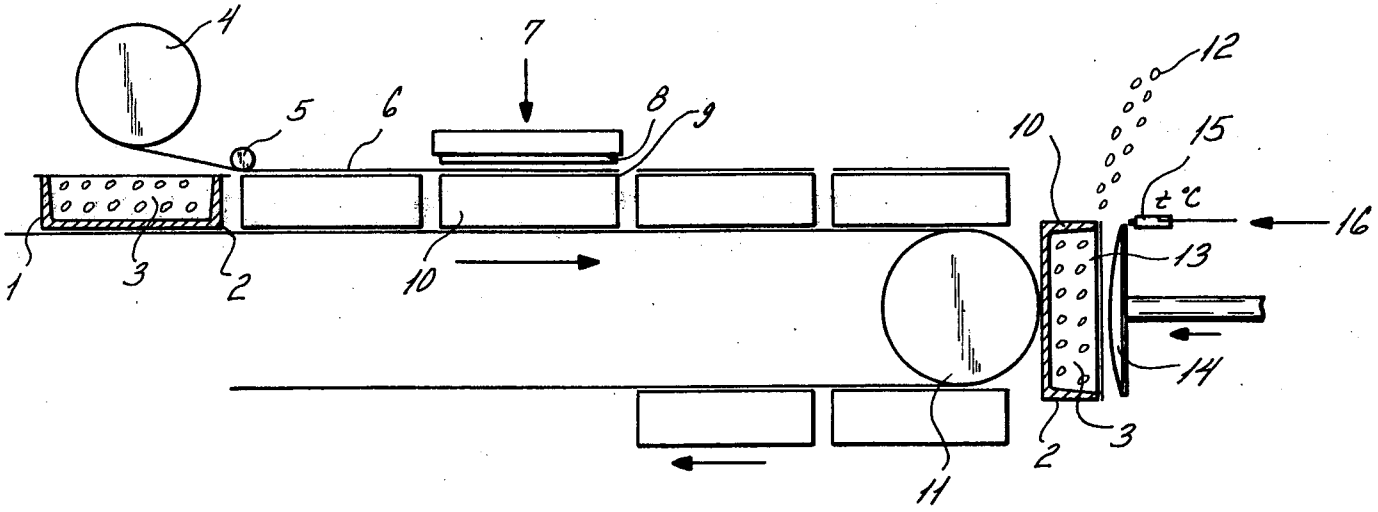

This invention relates to a method and apparatus for packaging foodstuffs.

In this specification the term foodstuffs includes staple diet items and semi-luxury and luxury foods, and accordingly includes items such as sausages, fish products, meat goods and the like, which may comprise liquid constituents such as pickle, conserving agents, sauces and the like.

In packaging foodstuffs such as sausages in plastics dishes with a suitable pickle, particular care must be taken to ensure that the individual working operations when closing the dishes are so controlled that any residual air bubbles which may be present in the plastics dishes or the liquid content thereof and which may promote germ activity are completely removed before the cover is finally sealed to the dish. Various ways of trying to achieve this have been previously proposed, for example by producing a reduced pressure in the package, but this has not proved entirely successful in the sausage packing industry, because sausagemeat is in most cases contained in soft skins or casings which expand under the effect of the reduced pressure to an excessive extent so that the packages burst or split.

Another method of storing sausages in plastics containers in pickle in such a way as to try to avoid the formation of air bubbles has encountered the problem that, due to the structure of the plastics package and the sausage, the formation of air bubbles cannot be entirely avoided and thus it is not possible to ensure that the packages are completely bubble-free when sealed.

According to the present invention, there is provided a method of packaging foodstuff which includes a liquid constituent, comprising: placing the foodstuff in a container which is in a horizontal position; applying a flexible cover to the container; sealing the cover to the edge of the container but leaving a gap between the container edge and the cover, the gap extending over only a limited part of the periphery of the container; turning the container from the horizontal position into an at least substantially vertical position, with the container so positioned that said gap is upwards; when the container is in said at least substantially vertical position pressing the cover inwardly of the container whereby the level of liquid in the container rises in the container towards said gap and gas in the container is displaced therefrom through said gap; sensing the arrival at said gap of said liquid level; and, in response to said sensing, sealing said gap to completely close the container.

The invention further provides apparatus for packing a foodstuff which includes a liquid consitiuent comprising: a conveyor device for conveying in a substantially horizontal position a container to contain the foodstuff; means for applying a flexible cover to the filled container; means for sealing the cover to the container, while leaving a gap between the edge of the container and the cover, which gap extends over only a limited part of the container periphery; means for turning the container with cover from said horizontal position into an at least substantially vertical position, with said gap upwards; means for applying a pressing force to said cover to press the cover inwardly of the dish whereby the level of liquid in the container rises toward said gap and gas in the container is displaced therefrom through said gap; and means for sealing said gap to completely close the container.

Figure 2:
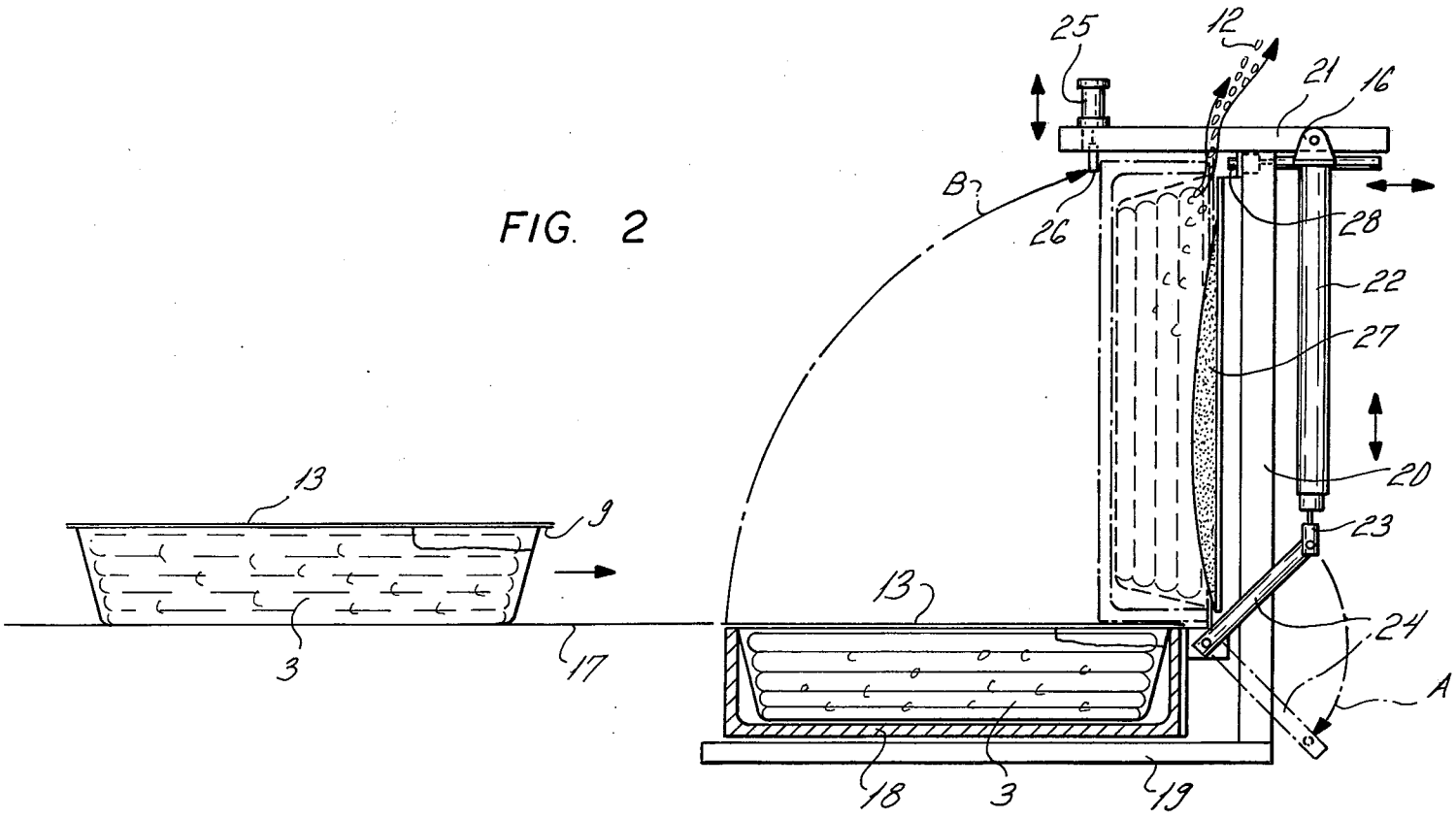

Embodiments of a method and apparatus according to the invention are described hereinafter by way of example with reference to the accompanying drawings, in which:

FIG. 1 shows a diagrammatic view of a first embodiment of the apparatus for performing one form of method of packaging a foodstuff, FIG. 2 shows a diagrammatic view of a second embodiment of the apparatus for performing another form of the method.

As shown in FIG. 1 a plastics dish or bowl 3 filled for example with sausage and pickle is carried on an intermittently displaced conveyor device 2 which comprises for example a plurality of chain members. The device 2 is provided with holders such as carrier pans 1 for receiving such a dish. The dishes 3 are successively passed below a storage roll 4 of cover film for covering the dishes, the web of film being drawn from the storage roll 4 and guided by one or more guide rollers 5 onto the dishes 3. The dishes 3 are passed through a preliminary sealing station 7 which operates rhythmically in the operating rhythm of the apparatus to weld the cover film to the respective dishes 3 to cover same. Thus, in the rest periods of the operating movement of the conveyor device 2, welding bars or beams 8 of the station 7, which are of a configuration corresponding to the shape of the dishes 3, press the cover film 6 onto the edge 9 of each plastics dish 3 and thereby seal it to the dish 3, forming a sealed cover 13, with the exception of a small marginal region which is left free or not contacted by the welding beams 8, thus forming a marginal gap at a location indicated generally at 10, for removing air from the dish 3.

In the intermittent advance periods of the conveyor device 2, the carrier pans 1 with the partially sealed dishes 3 pass through the direction-changing end region of the conveyor device 2, where there is a direction-changing or guide roller or wheel 11 which positively transfers the carrier pan 1 with the dish 3 and the cover 13 partly welded thereto, into a vertical position, i.e. in which the dish 3 is turned through 90° relative to its horizontal conveying position. In this vertical position, the marginal gap 10 is uppermost so that air bubbles or air-filled vapour bubbles 12 in the dish or its contents can best escape through the marginal gap 10 in an upward direction directly into the free air. Oscillating movements or shaking movements which can be varied as desired can be applied to the dish to assist in driving out gas from the dish.

In order to ensure that even the last residue of detrimental gaseous components is displaced from the dish and its contents, the liquid constituent of the foodstuff packaged in the dish can be caused to rise up to the marginal gap 10, by applying an external pressure to the cover 13. This is effected in the apparatus illustrated by a cover-pressing plate 14 which can be advanced in the direction of the longitudinal centre line of the device 2 to press the cover 13 and then retracted, being actuated hydraulically, pneumatically or in another suitable way. The roller 11 acts as an abutment to support the dish against the pressing force of the plate 14. Other means could be employed for applying pressure to the cover 13, for example a stationary plate can carry an interchangeable cushion-like flexible hollow diaphragm, the wall or walls of which can be subjected to the actuating pressure of a pressure medium for pressing the cover 13 inwardly of the dish until the air and liquid constituents therein are displaced as described above. The diaphragm could have a plurality of chambers in its interior, and such chambers could be inflated with a pressure medium in succession in an upward direction, so that the diaphragm would be displaced progressively into pressing contact with the dish cover 13, in a progressive wave-like upward motion, to stroke the cover 13 and displace air upwardly in the dish 3 to the gap 10.

It would alternatively be possible for a rolling member such as a foam roller or roller brush to pass continuously in an upward direction over the cover 13, when the dish 3 is in the vertical position or shortly before it reaches that position, thereby to press the cover 13 inwardly, the air-displacement operation allowing air in the dish to escape through the marginal gap 10 and also entraining the liquid constituent upwardly with it.

As soon as the liquid which is displaced upwardly by the pressure applied to the cover 13 has reached the marginal gap 10 and accordingly all air and vapour bubbles 12 have left the interior of the dish, a sensor or feeler which is responsive thereto produces for example a control pulse to provide for the advance of a sealing head 15 of an end sealing station 16. The sealing head 15 presses against the cover 13 to air-tightly weld the region of the cover 13 which are still open, to the edge 9 of the dish. The sealing head may be adjustable in respect of temperature and the time for which it is applied to the cover 13, as well as in respect of its working speed.

The dish 13 which is in this way sealed so as to be bubble-free and sterile is then removed from the carrier pan 1, transferred to a further conveyor device (not shown) and passed to a collecting station.

In FIG. 2, the dish 3 has been filled with sausage and pickle and pre-sealed except for the marginal gap 10 and is passed from the filling packaging machine e.g. on a conveyor belt 17 or a conveyor holder by which it is advanced to a separate holder or carrier member 18 onto which it is lowered by means of a lowering device (not shown). The carrier member 18 is suitably adapted to the respective dish 3. Associated with the carrier member 18 is a pivoting device which substantially comprises a frame formed by a base 19, support struts 20 and yoke beams 21, a pneumatically or hydraulically actuated cylinder-unit 22 with piston rod 23, and a lever 24 which is secured at one end to the carrier member 18 and at the other end to the rod 23. The carrier member is pivotal about a stationary point, as will be described below.

After the dish 3 has been laid down into the carrier member 18, the cylinder unit 22 is actuated so that its piston rod 23 pivots lever 24 downwardly in the direction of the arrow A, causing the carrier member 18 with the filled dish 3 to pivot through 90° in the direction indicated by arrow B into a vertical position. In this vertical position, a pneumatically or hydraulic cylinder unit 25 is actuated to cause a locking bolt or pin 26 to engage behind the carrier member 18 to secure the carrier member 18 in a stationary position relative to the upper beam 21.

As can also be seen from FIG. 2, in this position the partially sealed dish 3 is pressed against a pressure plate 27 which is fixed with respect to the frame. The plate 27 is of a convex configuration, whereby air and vapour bubbles 12 are displaced from the dish and its contents in an upward direction through the marginal gap 10 directly into the free air, the liquid components of the packaged material also advancing up to the marginal gap 10. In this way any excess liquid in the dish can also be discharged therefrom. Thereupon a sensor or detector means triggers the final sealing operation, and a sealing bar 28 seals the marginal gap 10.

As mentioned above, to ensure that the air vapour bubbles escape from the dish through the gap 10 at the highest point of the dish, the natural rising movement of the air and other gaseous vapour bubbles in the dish which has been pivoted from the horizontal into the vertical position can be assisted by oscillations or shaking, which can be varied as required, of the carrier pan (1 in FIG. 1) and/or the cover pressing plate 14 or the carrier member 18 and/or the plate 27. It will be appreciated that the methods as described above provide for careful treatment of the dish contents, as the contents are not subjected to a reduced pressure, nor are they subjected to any substantial pressure liable to cause bruising or other damage. In addition the dish itself is not subjected to any pressing force liable to damage it.

What we claim is:

1. A method of packaging foodstuff which includes a liquid constituent comprising: placing the foodstuff in a tray means which is in a horizontal position with its open face upwards; applying a flexible cover to the tray means; sealing the cover to the edge of the tray means but leaving a gap between that edge and the cover, the gap extending over only a limited part of the periphery of the tray means; turning the tray means from the horizontal position into an at least substantially vertical position, with the tray means so positioned that said gap is uppermost; when the tray means is in said at least substantially vertical position pressing the cover inwardly of the tray means such that the level of liquid in the tray means rises towards said gap and gas in the tray means is displaced therefrom through said gap; sensing the arrival of said liquid level at said gap; and, in response to said sensing, sealing said gap to completely close the tray means.

2. A method according to claim 1 wherein a shaking or vibrating action is applied to said tray means and/or said cover when in said vertical position to enhance the discharge of gas from the tray means.

3. A method according to claim 1 wherein the cover is pressed by a member which rolls against the cover in an upward direction.

4. A method according to claim 1 wherein said cover is provided from a web of plastics film drawn from a storage roll beneath which a succession of said tray means is advanced by a conveyor device.

5. A method according to claim 4 wherein the conveyor device includes an endless belt on which said tray means are supported, and wherein each said tray means is turned into said vertical position by the belt passing around an end guide roller.

6. A method according to claim 4 wherein each said tray means is transferred from said conveyor device into a pivoting assembly for turning the tray means into said at least substantially vertical position.

7. A method according to claim 1 wherein the cover is pressed by a pressure plate.

8. A method according to claim 7 wherein said plate has a convex pressing surface.

9. A method according to claim 1 wherein the cover is pressed by a fluid pressure-inflated diaphragm.

10. A method according to claim 9 wherein said diaphragm comprises a plurality of chambers which are inflated by a pressure fluid successively in an upward direction thereby to apply to the cover a pressing force which moves upwardly over the cover.

11. Apparatus for packaging a foodstuff which includes a liquid constituent comprising: a conveyor device for conveying in a substantially horizontal position a tray means to contain the foodstuff the open face of the tray being upwardly directed; means for applying a flexible cover to the filled tray means; means for sealing the cover to the tray means, while leaving a gap between the edge of the tray means and the cover, which gap extends over only a limited part of the periphery of the tray means; means for turning the tray means with the cover from said horizontal position into an at least substantially vertical position, with said gap upwards; means for applying a pressing force to said cover to press the cover inwardly of the tray means when the tray means is in said at least substantially vertical position such that the level of liquid in the tray means rises towards said gap and gas in the tray means is displaced therefrom through said gap; and means for sealing said gap to completely close the tray means.

12. Apparatus according to claim 11 wherein said conveyor device includes a belt carrying a plurality of holders for receiving respective said tray means, and wherein said turning means comprises an end guide roller of said belt.

13. Apparatus according to claim 11 wherein said pressing force applying means includes a rolling member which rolls upwardly over the cover.

14. Apparatus according to claim 11 including supporting means for carrying a rolled web of plastics film for forming each said cover, said supporting means being disposed above said conveyor device.

15. Apparatus according to claim 11 wherein said turning means includes a carrier member for receiving a tray means from the conveyor device, the carrier member being pivotal between an at least substantially horizontal position and an at least substantially vertical position.

16. Apparatus according to claim 15 including a fluid pressure-actuated cylinder unit for pivoting said carrier member.

17. Apparatus according to claim 11 wherein said pressing force applying means includes a pressing plate for bearing against said cover.

18. Apparatus according to claim 17 wherein said turning means includes a carrier member for receiving a tray means from the conveyor device, the carrier member being pivotal between an at least substantially horizontal position and an at least substantially vertical position and wherein said plate is stationary and said carrier means brings said cover into pressing contact with the plate.

19. Apparatus according to claim 12 wherein said pressing force applying means includes a fluid pressure-inflated diaphragm.

20. Apparatus according to claim 19 wherein said diaphragm comprises a plurality of chambers which are inflated by a pressure fluid successively in an upward direction thereby to apply to the cover a pressing force which moves upwardly over the cover.

* * * * *